United States Patent [19]

Sherman

[11] 4,390,418

[45] Jun. 28, 1983

[54] RECOVERY OF SOLVENT IN HYDROCARBON PROCESSING SYSTEMS

[75] Inventor: Philip B. Sherman, Orange, Tex.

[73] Assignee: Texaco Inc., White Plains, N.Y.

[21] Appl. No.: 377,293

[22] Filed: May 12, 1982

[51] Int. Cl.[3] ..... C10G 21/06; C10G 21/20

[52] U.S. Cl. ..... 208/326; 208/321

[58] Field of Search ..... 208/321, 326

[56] References Cited

U.S. PATENT DOCUMENTS

| | | | |
|---|---|---|---|
| 2,534,382 | 12/1950 | Skelton et al. | 208/321 |
| 2,923,680 | 2/1960 | Bushnell | 208/321 |
| 3,451,925 | 6/1969 | Morris et al. | 208/321 |
| 3,461,066 | 8/1969 | Morris et al. | 208/321 |
| 3,470,089 | 9/1969 | Morris et al. | 208/321 |
| 3,476,681 | 11/1969 | Davies et al. | 208/321 |
| 4,013,549 | 3/1977 | Bushnell | 208/323 |
| 4,017,383 | 4/1977 | Beavon | 208/321 X |
| 4,057,491 | 11/1977 | Bushnell et al. | 208/321 |
| 4,294,689 | 10/1981 | Sequeira, Jr. et al. | 208/326 |
| 4,342,646 | 8/1982 | Sherman | 208/326 |

*Primary Examiner*—Delbert E. Gantz
*Assistant Examiner*—Glenn A. Caldarola
*Attorney, Agent, or Firm*—Carl G. Ries; Robert A. Kulason; Robert Knox, Jr.

[57] ABSTRACT

A lubricating oil solvent refining process employing N-methyl-2-pyrrolidone as solvent in which solvent is recovered from a solvent-oil mixture in a staged series of vaporization zones at progressively increasing pressure with external heat supplied only to the vaporization stage having the highest pressure and control of vaporization in the lower pressure stages is effected by passing a minor portion of the vapors from the highest pressure stage to the lowest pressure stage. A high temperature vacuum flash vaporization zone may follow the high pressure vaporization stage with external heat supplied to the vacuum flash vaporization zone.

12 Claims, 1 Drawing Figure

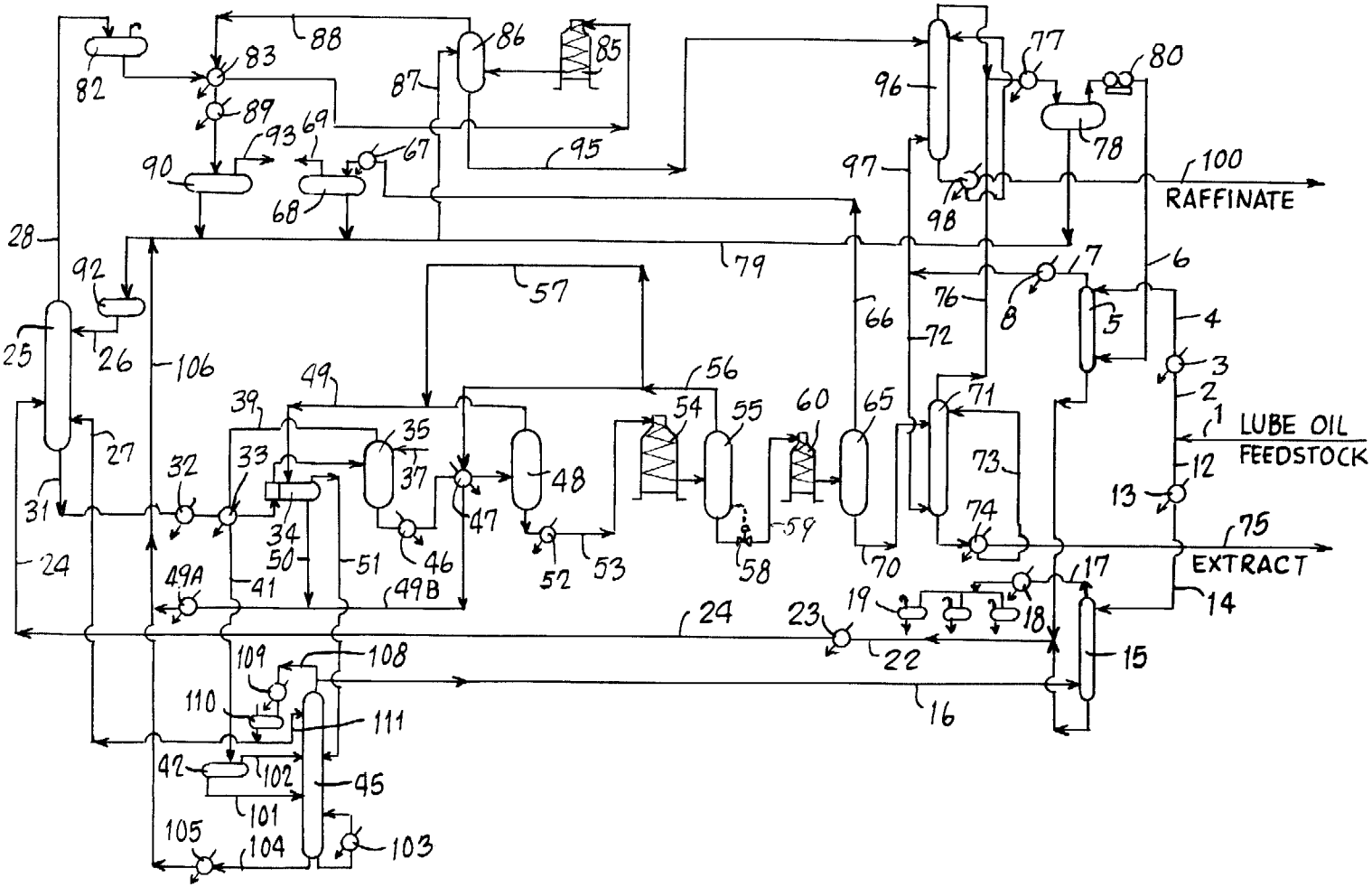
RAFFINATE
LUBE OIL
FEEDSTOCK
EXTRACT

RECOVERY OF SOLVENT IN HYDROCARBON PROCESSING SYSTEMS

The invention relates to an improved process for the recovery of solvent employed in processing a petroleum oil fraction containing constituents having different physical and chemical properties. In one of its more specific aspects, the invention relates to a method for recovering solvent from hydrocarbon extract in a lubricating oil solvent refining process utilizing N-methyl-2-pyrrolidone as a solvent.

It is well known that aromatic and unsaturated components of a hydrocarbon oil charge stock may be separated from the more saturated hydrocarbon components by various processes involving solvent extraction of the aromatic and unsaturated hydrocarbons. Suitable solvents have an affinity for at least one component of the hydrocarbon oil charge stock and are partially immiscible with the charge stock under the temperature and pressure conditions employed in the solvent extraction step. Two liquid phases are present in the extraction zone; the two liquid phases generally consist essentially of an extract phase containing the major amount of the solvent together with dissolved aromatic components of the charge stock and a raffinate phase containing non-aromatic components of the charge stock together with a minor amount of solvent. Among the solvents which are known to be useful for solvent extraction processing of petroleum base lubricating oil stocks are furfural, N-methyl-2-pyrrolidone, phenols, and other various well known organic and inorganic solvents. The removal of aromatics and other undesirable constituents from lubricating oil base stocks improves the viscosity index, color, oxidative stability, thermal stability, and inhibition response of the base oils and the lubricating oil products produced from hydrocarbon feedstocks.

Most recently N-methyl-2-pyrrolidone has displaced furfural and phenol in importance as a preferred solvent for extracting aromatic hydrocarbons from mixtures of aromatic and non-aromatic hydrocarbons. Some of the advantages of N-methyl-2-pyrrolidone as solvent are referred to, for example, in U.S. Pat. No. 4,057,491. N-methyl-2-pyrrolidone is effective for the solvent extraction of aromatic components from lubricating oil charge stocks at relatively lower temperatures and lower solvent-to-oil dosages than most other known solvents. N-methyl-2-pyrrolidone is generally the most preferred solvent because of its chemical stability, low toxicity, and its ability to produce refined oils of improved quality. Some of the prior art processes employing N-methyl-2-pyrrolidone as solvent and illustrating conventional solvent recovery operations are disclosed in U.S. Pat. Nos. 3,461,066 and 3,470,089.

The process of this invention is useful for upgrading existing N-methyl-2-pyrrolidone refining installations employing a single or multiple stage solvent recovery system and steam or inert gas stripping of the solvent from the products. The process of this invention is also particularly suited to the conversion of furfural and phenol process installations to N-methyl-2-pyrrolidone solvent systems with substantial savings in the energy requirements of the solvent refining process.

In recovering N-methyl-2-pyrrolidone from oil-solvent mixtures, e.g., the extract phase and the raffinate phase of a solvent refining system wherein solvent is separated from oil-solvent mixtures by a combination of distillation and stripping, stripping with an inert gas rather than with steam for solvent purification often reduces the energy requirements of the process, as compared with conventional steam stripping. Inert gas stripping has been disclosed, for example, in U.S. Pat. No. 2,923,680; 4,013,549 and 4,057,491.

In conventional lubricating oil solvent refining processes, the solvent extraction step is carried out under conditions effective to recover about 30 to 90 volume percent of the lubricating oil charge as raffinate or refined oil and to extract about 10 to 70 volume percent of the charge phase as an aromatic extract. The lubricating oil stock is contacted with a solvent, e.g., N-methyl-2-pyrrolidone, at a temperature at least 5° C., preferably at least 50° C., below the temperature of complete miscibility of said lubricating oil stock in the solvent.

In the extraction step, operating conditions are selected to produce a primary raffinate having a dewaxed viscosity index of about 75 to 100, and preferably about 85 to 96. Solvent extraction temperatures within the range of 43° to 100° C. (110° to 212° F.), preferably within the range of 54° to 95° C. (130° to 205° F.), and solvent dosages within the range of 50 to 500 volume percent, basis hydrocarbon feedstock, and preferably within the range of 100 to 300 volume percent, are suitable. Extraction pressure at the solvent to raffinate interface is preferably 1.4 bar to 2 bar. Water or wet solvent may be injected into the bottom of the extractor to control solvent power and selectivity.

To produce a finished lubricating oil base stock, the primary raffinate is dewaxed to the desired pour point. If desired, the refined or dewaxed oil may be subjected to a finishing treatment for color and stability improvement, for example, mild hydrogenation.

The operation of the extraction tower involves counterflow of the two immiscible liquid phases. Therefore, the mechanical feasibility of the process depends on a significant density difference between the solvent-rich phase, or extract phase, and the oil-rich phase, or raffinate phase. Within the solvent dosage range of 100 to 500 volume percent, i.e., 100 to 500 volumes of solvent to each 100 volumes of lubricating oil feedstock, the density difference increases with increased solvent dosage. At very low solvent dosages, for example, less than 100 percent, the density difference can become so low as to severely limit the throughput of feed to the solvent extraction tower.

N-methyl-2-pyrrolidone is such an effective solvent for aromatics that in the case of some hydrocarbon charge stocks the solvent dosage needed to produce the desired raffinate quality is impractically low. When operating an extraction tower with dry N-methyl-2-pyrrolidone at the minimum practical dosage, i.e., about 100 percent, and temperature, i.e., about 60° C. (140° F.), the refined oil quality is higher than desired and in some cases the refined oil yield is lower than desired.

The process of the invention overcomes this problem by operating the extraction step with a dry solvent dosage effective for rapid separation of the two liquid phases within the extraction tower, and refluxing the extraction tower by the introduction of water or wet solvent into the extraction tower near the point of withdrawal of the extract phase, i.e. between the point of introduction of the hydrocarbon feedstock to the separation system and the point of withdrawal of the extract phase, to obtain the desired quality raffinate product with a high yield of refined oil.

It has been proposed heretofore to add water to the N-methyl-2-pyrrolidone in the extraction tower either as such or in admixture with the solvent as a reflux to reduce the solubility of the aromatic hydrocarbons in the solvent. The present invention provides improvements in the methods of separating solvent from the extract and raffinate products, eliminating oil contamination in the solvent, and controlling the water content of the solvent in the solvent refining system, employing N-methyl-2-pyrrolidone as solvent. In one of its preferred embodiments, the present invention provides a process in which dry solvent is used as the primary solvent in the extraction tower and water or wet solvent is employed as a reflux whereby a high yield of refined oil of desired quality at a given solvent dosage is obtained. The solvent recovery may be simplified with a resultant savings in energy requirements of the process.

Briefly the present invention provides an improved method for recovery of solvent from the extract phase obtained on solvent refining lubricating oil base stocks wherein solvent is removed from the extract mixture by vaporization of solvent partially in a first low pressure solvent vaporization zone and then vaporizing further portions of the solvent from the extract in a plurality of zones at progressively higher pressures with heat from an external source supplied only to the last high pressure vaporization zone and heat for each preceding vaporization zone supplied by heat exchange with vapors from each succeeding vaporization zone and mixing part of the vapors from the last high pressure vaporization zone with vapors from a medium pressure vaporization zone as heat supply to the low pressure solvent vaporization zone. In a preferred embodiment, additional solvent is recovered from the extract by vaporization in a subatmospheric pressure flash zone following the high pressure vaporization zone at a temperature at least 5° C. higher than the temperature of the high pressure zone.

The process of the invention will be more readily understood by reference to the accompanying drawing and the following detailed description of a preferred embodiment of the process.

The FIGURE is a simplified flow diagram of a preferred embodiment of the process of the invention.

With reference to the FIGURE, petroleum base lubricating oil feedstock is supplied to the solvent refining process through line 1 and split into two streams. Part of the feedstock passes through line 2, heater 3 and line 4 to the upper part of absorber tower 5 wherein the lubricating oil feedstock is brought into intimate countercurrent contact with an inert stripping gas, e.g. nitrogen, containing solvent vapors entering the lower part of the absorber tower 5 through line 6. Absorber tower 5 comprises a countercurrent vapor-liquid contacting tower wherein liquid flowing down the tower is intimately contacted with gases and vapors passing upwardly through the tower. Means for ensuring intimate contact between vapor and liquid, e.g. bubble cap trays, perforated plates, packing material, or the like, are provided within the tower. A preferred embodiment of the process is illustrated and described as a specific example; in this example, the lubricating oil feedstock from line 2 is heated in heater 3 to a temperature of 66° C. and absorber 5 is operated at 1.7 bar. In the absorber 5, solvent vapors are absorbed by the lubricating oil feedstock and the recovered solvent returned with the feedstock to the process. Stripping medium, from which solvent has been removed, is discharged through line 7 and heater 8 for reuse in the process.

A second portion of the lubricating oil feedstock from line 1 is passed through line 12, heater 13 and line 14 into the upper part of an absorber tower 15 wherein the lubricating oil feedstock is brought into intimate countercurrent contact with a mixture of steam and solvent vapors entering the lower part of absorber 15 through line 16. Absorber 16 comprises a countercurrent contracting tower similar to absorber 5 described above and, as a specific example, may be operated at a pressure of 1.1 bar and a temperature of 102° to 104° C. Steam from which solvent has been removed is discharged through line 17 to condenser 18 wherein the steam is condensed and the condensate accumulated in "rate" drums 19 where it is stored until tested for solvent content and, if sufficiently low, released to the sewer system.

The lubricating oil feedstock streams discharged from the lower part of absorbers 5 and 15 are combined and passed through line 22, heater 23, and line 24 to the lower part of extraction tower 25 wherein the lubricating oil feedstock is intimately countercurrently contacted with dry N-methyl-2-pyrrolidone solvent introduced into the upper part of extraction tower 25 through line 26. As used herein, "dry" N-methyl-2-pyrrolidone means N-methyl-2-pyrrolidone containing 0.3 weight percent water or less. As a specific example, extract tower 25 is operated at an interface pressure of 1.4 to 2 bar; in this example 1.4 bar with a raffinate outlet temperature of 63° C. and an extract outlet temperature of 46° C.

The raffinate mixture, comprising typically 85 percent hydrocarbon oil admixed with solvent is discharged from the extraction tower 25 through line 28 and processed for the recovery of raffinate from the solvent. The raffinate, after separation of solvent, is a solvent refined lubricating oil base stock, the desired product of the process. The recovery of solvent from the raffinate is described hereinafter.

The major portion of the solvent is contained in the extract mixture withdrawn from the bottom of extraction tower 25. In this example, an extract mixture comprising about 85 percent solvent is withdrawn from tower 25 through line 31 and passed through heat exchangers 32, 33 and 34, which serve to preheat the mixture, into a lower pressure flash tower 35 wherein water and part of the solvent are vaporized. Flash tower 35 is provided with vapor-liquid contacting means, e.g. cascade trays, in its upper part to effect countercurrent contact between reflux liquid flowing down the tower and solvent vapors flowing up the tower. A part of the extract mixture from the bottom of tower 35 is cooled by means not illustrated and is reintroduced through line 37 into the upper part of tower 35 as reflux. Flash tower 35 may be operated at a pressure in the range of 1.15 to 1.4 bar; as a specific example, the flash tower pressure is 1.15 bar and the flash tower temperature is about 202° C.

Solvent vapors separated from the extract mixture in flash tower 35 contain water vapors. The solvent vapors mixed with water vapor pass through line 39 to heat exchanger 33 where most of the solvent vapor and a little of the water vapor are condensed preheating the extract mixture from line 31. Condensate and uncondensed vapors pass through line 41 to accumulator 42 as part of the feed to drying tower 45 as described hereinafter.

The major portion of the extract mixture, from which part of the solvent has been removed by vaporization in flash tower 35, is passed through heat exchangers 46 and 47 to medium pressure flash tower 48 similar to low pressure flash tower 35. The medium pressure flash tower 48 suitably is operated at a pressure in the range of 1.7 to 1.97 bar; in this specific example, the medium flash tower pressure is 1.72 bar and the flash tower temperature is 232° C. A minor portion of the extract solvent mixture from the bottom of flash tower 35 is introduced to the upper part of the flash tower 48 as reflux in known manner, not illustrated.

The solvent vapors leaving the top of medium pressure flash tower 48 through line 49 are passed to heat exchanger-condenser 34 in indirect heat exchange with the extract mixture from the bottom of extraction tower 25, condensing part of the solvent vapors and preheating the extract mixture prior to its introduction to low pressure flash tower 35. Condensate from heat exchanger-condenser 34 is passed through line 50 as dry solvent for reuse as described hereinafter. Uncondensed solvent and water vapors from heat exchanger 34 pass through line 51 to drying tower 45 as part of the feed to the drying tower described hereinafter.

Extract mixture from which a further part of the solvent has been removed by vaporization in flash tower 48, is withdrawn from the lower part of flash tower 48 and passed through heat exchanger 52 and line 53 to heater 54 where the mixture is heated to a temperature in the range of 288° to 310° C. and introduced into high pressure flash tower 55 for the removal of most of the remaining solvent from the extract mixture. The high pressure flash tower 55 suitably is operated at a pressure within the range of 2.9 to 3.14 bar and in this specific example at 2.9 bar. A minor portion of the extract solvent mixture from the bottom of flash tower 35 is introduced to the upper part of the high pressure flash tower 55 as reflux in known manner, not illustrated.

The major portion of the solvent vapors leaving the top of high pressure flash tower 55 through line 56 are passed through heat exchanger 47 in indirect heat exchange with the extract mixture from low pressure flash tower 35, condensing the solvent vapors and supplying heat to the extract mixture prior to its introduction to medium pressure flash tower 48. Solvent vapors are condensed in heat exchanger 47 and the condensate passed through line 49B, solvent cooler 49A, and line 106 to dry solvent storage 92 as part of the dry solvent supplied to extraction tower 25.

In accordance with a preferred embodiment of the present invention, a portion of the solvent vapors from high pressure flash tower 55 is passed through line 57 to line 49 into admixture with solvent vapors from medium pressure flash tower 48 and the mixture passed through line 49 to heat exchanger 34 to supply additional heat to the extract mixture from extraction tower 25 and maintain the desired temperature in low pressure flash tower 35. Suitably from 2 to 10 percent of the solvent vapors from the high pressure flash tower 55 are passed through 57 to line 49 and heat exchanger 34 for this purpose.

The hydrocarbon oil extract withdrawn from the bottom of high pressure flash tower 55 through expansion valve 58 and line 59 still contains some solvent, for example, 20 volume percent solvent and 80 volume percent hydrocarbon extract. This extract mixture is reheated in heater 60 to a temperature above the temperature of high pressure flash tower 55 and introduced into vacuum flash tower 65 for further recovery of solvent from the extract. The vacuum flash tower may operate at a pressure within the range of 0.25 to 0.55 bar, and at a temperature in the range of 293° to 315° C.; in this specific example the vacuum flash tower pressure is 0.45 bar and the operating temperature is 293° C. A portion of the extract solvent mixture from the bottom of flash tower 35 is supplied to the top of vacuum flash tower 65 as reflux in known manner, not illustrated.

In the vacuum flash tower 65, additional separation of extract from solvent takes place. Solvent vapors are withdrawn from the top of flash tower 65 through line 66 to a condenser 67 and solvent accumulator 68. Uncondensed gases are withdrawn from accumulator 68 through line 69 to a suitable vacuum source, not illustrated, and may be discharged from the system.

An extract rich fraction is withdrawn from the bottom of flash tower 65 through line 70 and introduced into the upper portion of extract stripping tower 71. Extract stripping tower 71 is typically a countercurrent vapor-liquid contact column provided with bubble cap trays in which the liquid extract flowing downwardly through the column is contacted with inert stripping gas introduced into the lower portion of tower 71 through line 72. A part of the extract mixture from the bottom of stripping tower 71 is cooled and returned to the upper portion of the tower as reflux through line 73.

Extract oil containing less than about 50 parts per million solvent, and typically comprising 80 weight percent unsaturated hydrocarbons and about 20 percent saturated hydrocarbons, is withdrawn from the lower end of stripping tower 71, passed through heat exchanger 74 where it is cooled, and discharged from the system through line 75 as a product of the process.

Inert stripping gas, e.g. nitrogen, and stripped solvent vapors are discharged from the upper part of stripping tower 71 through line 76 to condenser 77 where solvent vapors are condensed. Solvent condensate is collected in condensate accumulator 78 and returned through line 79 to dry solvent storage 92 for recycle to extraction tower 25. Inert gas separated from the condensate solvent in separator 78 is recirculated by compressor 80 to line 6 and absorber 5 for the recovery of trace amounts of solvent contained in the recirculated stripping gas. In this example, extract stripping tower 71 is operated at a pressure just above atmospheric pressure, e.g., 1.1 bar to 1.3 bar and a temperature of 299° C. Condenser 77 cools the stripping gas and solvent to a temperature of the order of 60° C. effecting condensation of the major part of the solvent from the nitrogen or other stripping gas prior to recycle to absorber 5. Absorber 5 recovers substantially all of the residual solvent from the recycle nitrogen stream.

Raffinate mixture taken overhead from extraction tower 25 through line 28 typically comprises about 15 volume percent solvent and 85 volume percent hydrocarbons. In this particular example, the extraction tower is operated with a dry solvent dosage of 100 volume percent, i.e. one volume of solvent for each volume of oil charge stock. In the specific example, raffinate mixture is discharged from the extraction tower at a temperature of 63° C. The raffinate mixture from line 28 is collected in run tank 82, and heated in heat exchanger 83 and in a fired heater 85 prior to introduction into vacuum flash tower 86 wherein solvent is separated from the raffinate mixture. In one preferred embodiment, raffinate vacuum flash tower 86 is operated at a pressure of 0.7 bar and a temperature of the order of 298° C. Reflux from a suitable source, e.g. dry N-methyl-2-pyrrolidone, is supplied to the top of vacuum flash tower 86 through line 87 as reflux.

In raffinate vacuum flash tower 86, separation of the major portion of the solvent from the raffinate takes place. Solvent vapors are withdrawn from the top of flash tower 86 through line 88; heat exchanger 83, and cooler 89 to solvent accumulator 90. Condensate solvent from accumulators 90 and 68 flow through line 79 to run tank 92 from which dry solvent is withdrawn through line 26 to extraction tower 25. Uncondensed gases are withdrawn from solvent accumulator 90 through line 93 to a suitable vacuum source, not illustrated, and may be discarded or further processed for the recovery of solvent vapors therefrom.

Raffinate, still containing some solvent, is withdrawn from the lower part of vacuum flash tower 86 through line 95 to the upper part of stripping tower 96, wherein residual solvent is removed from the raffinate by stripping with inert gas. Inert gas from absorber 5 is introduced into the lower part of stripping tower 96 via lines 7 and 97. A minor portion of the raffinate from the raffinate cooler 98 is reintroduced to the upper part of the raffinate stripping tower 96 as reflux in known manner, not illustrated. In a preferred embodiment, raffinate stripping tower 96 is operated at a pressure just above atmospheric pressure, e.g. 1.1 to 1.3 bar and at a temperature of 288° C. Nitrogen containing solvent from stripper 96 is combined with nitrogen containing solvent from stripper 71 and cooled in condenser 77 for condensation of solvent from the stripping gas recirculated to absorber 3.

Raffinate, substantially free from solvent, is withdrawn as a product of the process from the lower portion of stripper 96 through heat exchanger 98 where it is cooled and discharged to line 100 as the refined lubricating oil stock, the principal product of the process.

The solvent purification system of this process comprises drying tower 45 where water vapor or steam mixed with solvent vapors from low pressure flash tower 35 and from medium pressure flash tower 48 are processed for the recovery of dry solvent for reuse in extraction tower 25. Solvent vapors containing water vapor or steam are passed from low pressure flash tower 35 through line 39 to heat exchanger 33 wherein the vapors are cooled and partially condensed by heat exchange with the extract mixture leaving the bottom of extraction tower 25 through line 31. The resulting vapor-liquid mixture comprising wet solvent, solvent vapors, and water vapor pass through line 41 to accumulator drum 42 wherein wet solvent (liquid) is separated from solvent vapors and steam. From accumulator drum 42, wet solvent is introduced into drying tower 45 through line 101 and steam containing solvent vapors is introduced into drying tower 45 through line 102 wherein dry solvent is separated from steam and solvent vapors. Solvent vapors from medium pressure separator 48 containing water vapor are passed through line 49 to heat exchanger-condenser 34 wherein they are cooled and partially condensed by indirect heat exchange with extract mixture from line 31. In heat exchanger-condenser 34 the extract mixture is preheated prior to its introduction to low pressure flash tower 35 condensing a portion of the solvent vapors from line 49. The condensed solvent is essentially free from water vapor and is withdrawn from heat exchanger-condenser 34 through line 50 to line 49B and passed through line 106 to dry solvent accumulator 92. Uncondensed vapor from heat exchanger-condenser 34 is passed through line 51 to drying tower 45 for the recovery of solvent therefrom.

Drying tower 45 comprises a fractionating column provided with suitable means, for example, perforated plates or bubble cap trays, for ensuring intimate countercurrent contact between vapors rising upwardly through the column and liquid flowing downwardly therethrough. Drying tower 45 is provided with a reboiler 103 at the bottom of the fractionating column to vaporize all of the water and part of the solvent entering the drying tower with the various feed streams. Dry N-methyl-2-pyrrolidone is withdrawn from the bottom of drying tower 45 through line 104, cooled in heat exchanger 105, and passed through line 106 to dry solvent accumulator 92 as dry solvent for extraction tower 25. In this specific example, drying tower 45 is operated at a pressure of 1.08 bar with a bottom temperature, i.e. reboiler temperature, of 216° C. and a tower top temperature of 104° C. to 132° C.

Part of the steam and accompanying solvent vapors taken overhead from drying tower 45 pass through line 108 and is cooled and condensed in condenser 109. Condensate water containing a small amount of solvent is accumulated in water drum 110 from which part of the water is returned through line 111 to the top of drying tower 45 as reflux and part is passed through line 27 to extraction tower 25 as a solvent modifier or reflux for the extraction tower. The remaining part of the overhead vapor from drying tower 45 comprising steam containing a minor amount of N-methyl-2-pyrrolidone is passed through line 16 to absorber tower 15 where it is brought into intimate countercurrent contact with a portion of the feed from line 14 recovering the solvent from the steam.

In solvent refining systems, such as the one described herein, water almost inevitably enters the system with the lubricating oil feedstock so that even in a dry solvent extraction system, means must be provided for the removal of extraneous water from the system. Other sources of water contamination in a system such as the one described herein occur from leaks in heaters or heat exchangers employing steam or water as a heat exchange medium. Excess water is eliminated in the process of this invention by passing the excess water in the form of steam through line 16 to absorber tower 15 for trace solvent removal before condensation in condenser 18 and collection of the reject water in rate drum 19.

It will be evident to one skilled in the art that the process of this invention permits extraction of lubricating oil charge stocks with dry N-methyl-2-pyrrolidone as solvent and at the same time provides control of the selectivity of the solvent by the use of water reflux while providing an energy efficient solvent recovery system.

I claim:

1. In a process for solvent refining a lubricating oil feedstock wherein said lubricating oil feedstock is contacted under pressure with N-methyl-2-pyrrolidone as a selective solvent for aromatic constituents of said feedstock in an extraction zone under solvent refining conditions thereby forming a raffinate phase comprising a minor amount of said solvent and an extract phase comprising extract and a major amount of said solvent, said raffinate phase is separated from said extract phase, and said solvent is removed from said extract by vaporization serially in a first solvent vaporization zone at a pressure less than that of said extraction zone and in a plurality of zones at progressively higher pressure and wherein heat from an external source is supplied only to said last high pressure vaporization zone and heat for each preceding vaporization zone is supplied by heat exchange with vapors from each succeeding vaporization zone, the improvement which comprises passing a minor portion of the vapors from said last high pressure vaporization zone into admixture with vapors from the next preceding vaporization zone to supply additional heat to said first solvent vaporization zone.

2. A process according to claim 1 wherein the pressure of said first stage flash vaporization zone is in the range of 1.15 to 1.4 bar and subsequent flash vaporization zones are in the ranges of 1.7 to 2 bar and 2.9 to 7 bar respectively.

3. In a process as defined in claim 1 and wherein additional solvent is recovered from said extract by vaporization in a subatmospheric pressure flash zone and residual solvent is stripped from said extract with an inert stripping gas, the improvement which comprises heating extract from the last high pressure zone to a temperature at least 5° C. higher than the temperature of said high pressure zone prior to introduction to said flash zone, withdrawing extract from said subatmospheric pressure flash zone and removing the last traces of solvent from said extract by stripping with an inert stripping gas at a low superatmospheric pressure.

4. A process according to claim 3 wherein said vacuum flash is at a pressure in the range of 0.25 to 0.55 bar.

5. A process according to claim 4 wherein said inert gas stripping zone is at a pressure in the range of 1.1 to 1.3 bar.

6. A process as defined in claim 3, wherein a minor portion of the stripped extract is returned to said stripping zne as reflux therefor.

7. A process according to claim 1 comprising the steps of condensing solvent-rich vapors from said vaporization zones and returning recovered solvent to said extraction zone.

8. A process according to claim 7 wherein solvent containing water is removed from said first flash vaporization zone and passed to a solvent dryer wherein water is separated from said solvent by distillation.

9. A process according to claim 8 wherein a portion of the solvent-rich vapors from a succeeding higher pressure vaporization zone is passed to said solvent dryer.

10. A process according to claim 9 wherein from 2 to 10 volume percent of said solvent rich vapors from said higher pressure vaporization zone are passed to said solvent dryer.

11. A process according to claim 1 wherein said N-methyl-2-pyrrolidone supplied as solvent to said extraction zone is substantially free from water and water is introduced into said extraction zone intermediate to the point of introduction of said feedstock and the point of withdrawal of said extract phase.

12. A process according to claim 11 wherein said water is supplied by wet N-methyl-2-pyrrolidone supplied to said extraction zone near the point of withdrawal of said extract phase.

* * * * *